US006664454B1

(12) United States Patent
Johnson

(10) Patent No.: US 6,664,454 B1
(45) Date of Patent: Dec. 16, 2003

(54) MUSICAL INSTRUMENT

(76) Inventor: Mark A. Johnson, 2290 E. Fisher La., Salt Lake City, UT (US) 84109

( * ) Notice: Subject to any disclaimer, the term of this patent is extended or adjusted under 35 U.S.C. 154(b) by 384 days.

(21) Appl. No.: 09/605,229

(22) Filed: Jun. 28, 2000

Related U.S. Application Data

(60) Provisional application No. 60/141,640, filed on Jun. 30, 1999.

(51) Int. Cl.[7] ..... G10D 3/02

(52) U.S. Cl. ..... 84/383 R; 84/377

(58) Field of Search ..... 84/377, 378, 383, 84/383 A, 383 R

(56) References Cited

U.S. PATENT DOCUMENTS 3,905,268 A * 9/1975 Gamble ..... 84/383 A

OTHER PUBLICATIONS

Internet, The Didgeridoo Store.*

* cited by examiner

*Primary Examiner*—Kimberly Locket
(74) *Attorney, Agent, or Firm*—Brian C. Trask

(57) ABSTRACT

A musical instrument capable of producing the sound spectrum associated with a traditional Australian didjeridoo, but in a more compact and portable form. In certain embodiments, an air column follows a tortuous path between a mouthpiece, having an input orifice between about one to about one-and-one-half inches in diameter, and an exit port. The air column is housed within a body having a length. The ratio of length of the air column to the instrument body length is preferably greater than 1.5 to provide a compact instrument. The instrument may be manufactured tuned to a traditional key-scale note, and may include tone holes to play other fundamental notes. In certain embodiments, a vibrating membrane may be provided in sealed relation over one or more through-holes in the body to produce other sounds of which a traditional didjeridoo is incapable.

19 Claims, 4 Drawing Sheets

MUSICAL INSTRUMENT

PRIORITY CLAIM

This application claims the priority of United States provisional patent application serial No. 60/141,640, filed Jun. 30, 1999, for "MUSICAL INSTRUMENT".

FIELD

This invention pertains to musical instruments. It is particularly directed to end blown wind instruments patterned after the Didjeridoo of the Australian Bushman. It provides an end blown, compact, Didjeridoo-type wind instrument of increased versatility.

BACKGROUND

The Didjeridoo musical instrument has been in use by the Australian Bushman for more than 40,000 years. It consists of a relatively long hollow tube, typically at least four feet in length. In its original form, it was fashioned from a eucalyptus tree branch which had been hollowed out by termites. The internal chamber was characteristically irregular in shape and dimension, with a nominal diameter of up to several inches. The narrowest end of the hollow tube has customarily been modified to interface comfortably with a human mouth. This modification has typically involved applying a workable substance, such as beeswax, to a terminus of the tube, and modeling it into a mouthpiece. A conventional such mouthpiece comprises an approximately axial opening about one to one-and-a-half inches in diameter. In operation, a percussive drone output sound is produced by placing the mouth against the mouthpiece, and blowing through relaxed lips to produce a soft sputtering input sound (as opposed to the buzzing input associated with the playing of brass instruments.)

In recent years, Didjeridoo instruments have been produced in various countries of the world from a variety of materials, including native woods, plastics, fabrics, leathers and clays, among others. Each instrument produces unique characteristic sounds because of their respective unique specific shapes, densities, surface textures and other physical properties. Instruments of various lengths produce drones of various pitch, but a tube length of several feet is essential to produce drone fundamental and overtone pitches. There has evolved an enthusiasm for Didjeridoo playing at both the amateur and professional levels for a variety of reasons. Transport of the instruments is difficult because of their size and sometimes fragile nature. Because of the straight configuration of the vibrating air column, it has not been practical to utilize tone holes to vary the pitch of the instrument. Holes located within reach of the instrumentalist are at the input end of the column, and therefore produce very elevated pitches. Such elevated tones have limited utility.

Another ancient instrument, produced in the 16th century, the "Rackett," incorporated a tortuous passageway within a canister. Sound was produced by blowing through a double reed, fashioned much as a modern bassoon reed. The internal air passage was much longer than the canister length, thereby producing a tone of lower pitch than could otherwise be obtained from an instrument of comparable size. Pitch changes were effected by an elaborate pattern of fingering holes in communication with the air passage. By contrast, only minor pitch changes are possible with traditional Didjeridoos, and any such changes are effected through changes in lip tension.

SUMMARY OF THE INVENTION

A Didjeridoo-type instrument is simulated by means of a tortuous path chamber pattern constructed within a shell or housing which forms a body. The manner of playing the instrument to produce a fundamental drone sound is substantially identical to that of a traditional Didjeridoo. Moreover, the techniques which have been developed to produce interesting sonic textures, patterns, overtones and similar effects of a traditional instrument are equally applicable and effective when applied to the invention. For example, circular breathing techniques are fundamental to proper operation of both categories of instrument. The invention offers several striking advantages; including compact, easily transportable configurations and increased versatility of sound production. A notable characteristic of certain instruments constructed in accordance with this invention is the ability to produce drone sounds at both fundamental and overtone pitch levels. It is also feasible to locate tone holes within reach of the instrumentalist, thereby making it feasible to modify the effective length of the vibrating air column at its exit port and play additional fundamental notes from one instrument.

The present invention provides a musical instrument capable of reproducing the sound spectrum typically associated with an Australian Didjeridoo. Such instruments are constructed and arranged to provide a tortuous path air chamber with a first mouth piece at a first end configured to permit an instrumentalist to blow through the mouthpiece in a loose-lipped fashion, whereby to create a Didjeridoo-type drone. The tortuous path through the instrument body is constructed to have a minimum total length longer than the length of the instrument body. A suitable air column may be formed by a plurality of baffle walls and baffle blocks arranged to form a plurality of air column segments. The segments may be characterized as "folded" linear sections, or serpentine segments. In certain preferred embodiments, the tortuous path has a total length at least one-and-a-half times as long as the length of the instrument to provide a compact instrument. The mouthpiece typically has a passageway opening, in communication with the air chamber, sized between about one to about one-and-one-half inches in diameter. Certain exemplary instruments have a body with one or more tone holes positioned to establish or change the fundamental note of the instrument when opened or closed. Other instruments may have one or more through-holes in fluid communication with the air column and sealingly covered by a membrane, such that the membrane may function to produce an audible sound while playing the instrument. A friction surface operable to create a percussive sound when stroked with a stylus may also be provided at one or more locations on a body. Some instruments may have a second mouthpiece at a second end, whereby to permit playing the instrument from either of the ends. One advantage of such an arrangement is that the fundamental note may have a different pitch when played from each respective end. The sound producing features disclosed herein may be incorporated in any combination to form an instrument capable of producing the desired instrumental sound.

These features, advantages, and alternative aspects of the present invention will be apparent to those skilled in the art from a consideration of the following detailed description taken in combination with the accompanying drawings.

BRIEF DESCRIPTION OF THE DRAWINGS

In the drawings, which illustrate what is currently regarded as the best mode for carrying out the invention.

DETAILED DESCRIPTION OF THE ILLUSTRATED EMBODIMENTS

Figure 1:
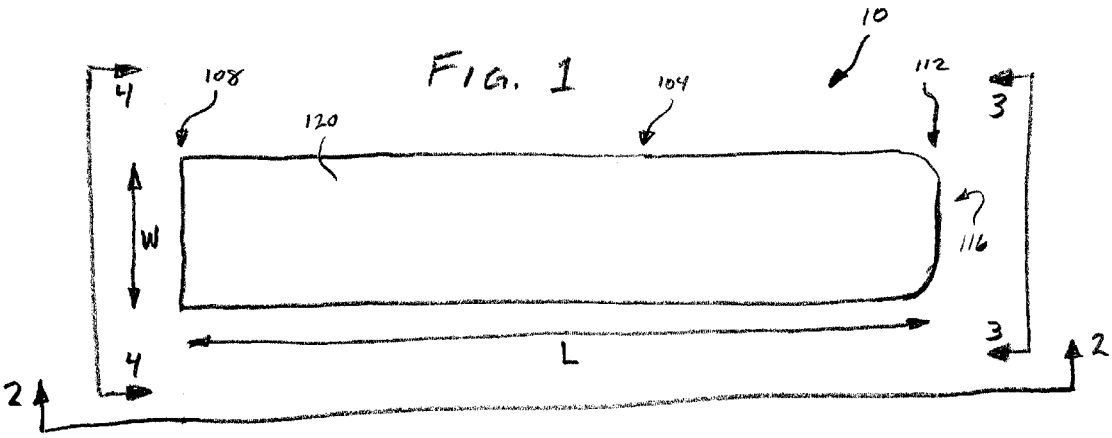
FIG. 1 illustrates a front view of a first embodiment of the invention.
Figure 2:
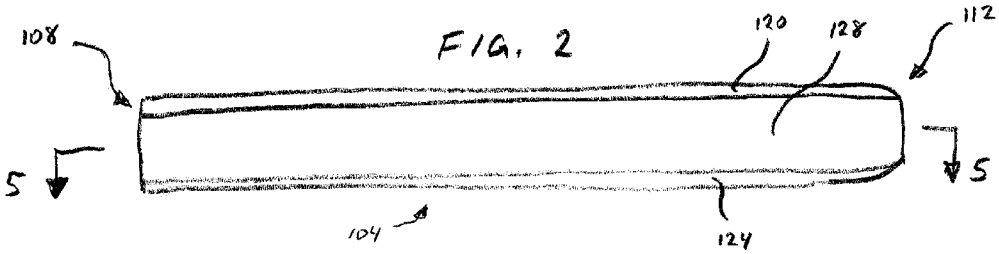
FIG. 2 illustrates a side view, looking in the direction of the arrows 2—2, of the embodiment of FIG. 1.
Figure 3:
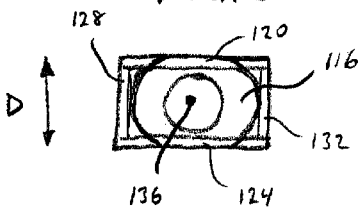
FIG. 3 illustrates an end view, looking in the direction of the arrows 3—3, of the embodiment of FIG. 1.

Reference will now be made to the drawings in which the various elements of the invention will be given numerical designations and in which the invention will be discussed so as to enable one skilled in the art to make and use the invention. It is to be understood that the following description is only exemplary of the principles of the present invention, and should not be viewed as narrowing the claims which follow.

These musical instruments are sold by Mark A. Johnson, Salt Lake City, Utah, under the trademark "DIDJBOX", and are constructed in several models. The invention will be made reference to throughout the remainder of this disclosure as an instrument. An instrument according to the invention can be made from any convenient material, including woods, plastics, glass, clay, fabrics, papers, metals or any other material capable of being worked, modeled or formed into a construction providing a tortuous path for a vibrating air column. The materials of composition have an effect upon the overtonal qualities of the resulting instrument.

For purposes of this disclosure, a minimum path length of an air column may be defined as the sum of the lengths of the minimum number of straight line segments which can be drawn through a cross-section of the air column from end-to-end. The present invention provides an air column having a minimum length greater than the length of the instrument. A compactness factor may be defined as the ratio of minimum air column length to the instrument length. It is currently thought that a compactness factor of approximately one-and-a-half is about the minimum such factor desirable in the present invention. An increase in the compactness factor generally results in an increasingly portable instrument.

FIGS. 1–5 illustrate a first embodiment of the invention, indicated generally at 10. The instrument 10 has a body 104 spacing apart a bottom end 108 and a top end 112. A mouthpiece 116 may be located on the top end 112 of this embodiment 10. It is within contemplation also alternatively to locate a mouthpiece 116 at other locations along body 104. However, it is generally preferred to locate mouthpiece 116 near or on an end.

In all of the FIGS. 1–22, width, depth and length directions are similarly defined, and indicated by arrows designated W, D, and L respectively, to form a Cartesian coordinate reference system. As illustrated in FIGS. 1–5, body 104 of instrument 10 may be formed from front sheet 120, rear sheet 124, right side panel 128, and left side panel 132. Such construction forms a simple hollow box having open opposite ends. Exemplary instrument 10 has a substantially constant width and depth along its length. Top end 112 may be rounded, as illustrated, to form a pleasing appearance. The external shape of an instrument is not limited to the relatively simple prismatic example embodiments illustrated herein. A representative instrument 10 may be constructed having overall length, width, and depth dimensions of 16 inches, 3⅛ inches, and 2 inches, respectively.

A mouthpiece 116 typically is positioned at top end 112. However, it is further within contemplation for a mouthpiece 116 to be positioned at both ends 108 and 112. A mouthpiece 116 typically has an axial opening 136 with an orifice sized to accommodate the lips of an instrumentalist, and through which such instrumentalist may blow in loose-lipped fashion to provide a loose-lipped sputtering input sound. Opening 136 may be circular in cross section, and in such case, is generally between one to one-and-a-half inches in diameter. Circular or ovoid cross-sectional shapes are preferred in an axial opening 136 through mouthpiece 116, although other shapes are also workable. A musician must simply be able to generate a loose-lipped, or sputtering type, input sound through the mouthpiece 116.

Figure 4:
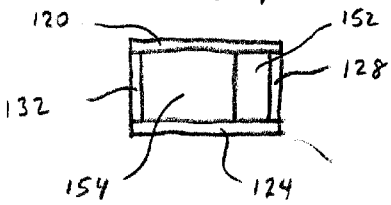
FIG. 4 illustrates an end view, looking in the direction of the arrows 4—4, of the embodiment of FIG. 1.
Figure 5:
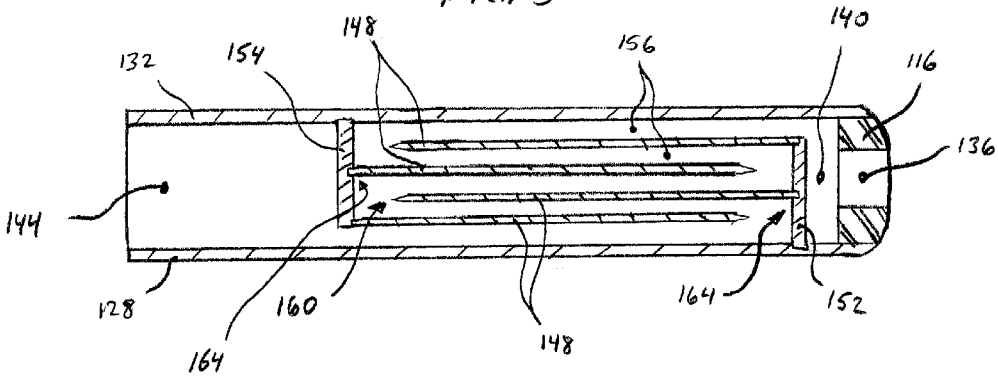
FIG. 5 illustrates a section view of the embodiment of FIG. 2, taken along section 5—5 and looking in the direction of the arrows.
Figure 6:
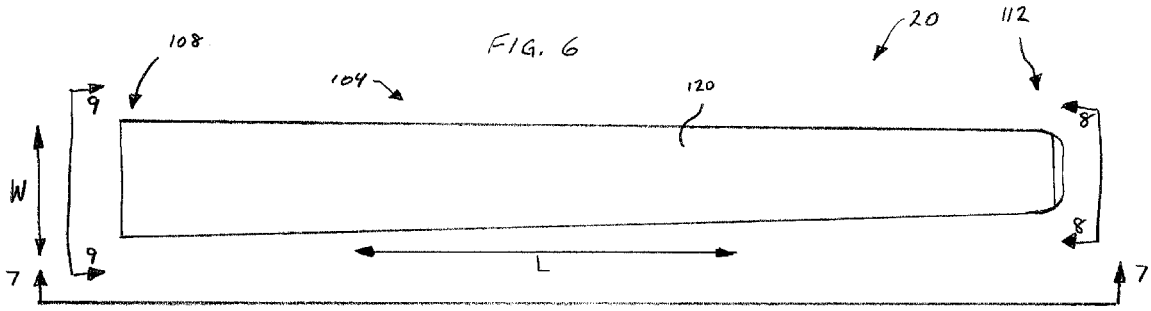
FIG. 6 illustrates a front view of a second embodiment of the invention.
Figure 7:
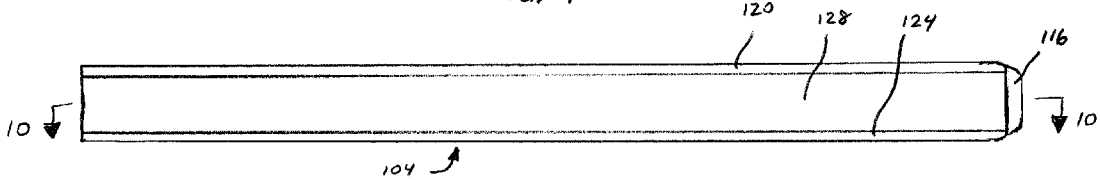
FIG. 7 illustrates a side view, looking in the direction of the arrows 7—7, of the embodiment of FIG. 6.
Figure 8:
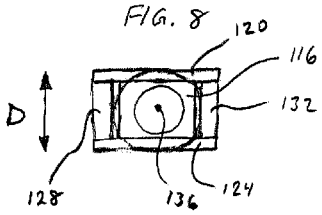
FIG. 8 illustrates an end view, looking in the direction of the arrows 8—8, of the embodiment of FIG. 6.
Figure 9:
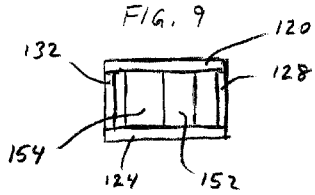
FIG. 9 illustrates an end view, looking in the direction of the arrows 9—9, of the embodiment of Figure.
Figure 10:
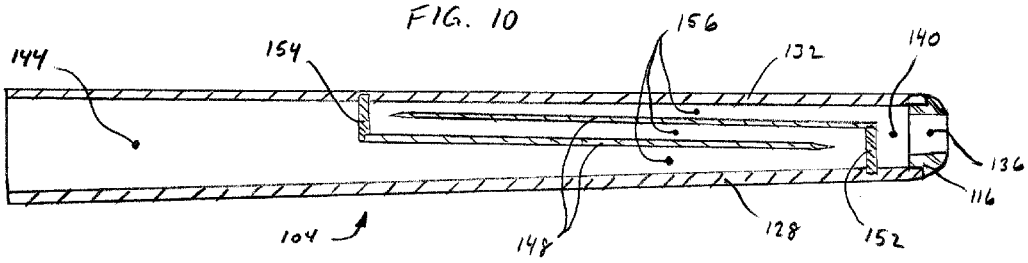
FIG. 10 illustrates a section view of the embodiment of FIG. 7, taken along section 10—10 and looking in the direction of the arrows.

A representation of the internal arrangement of elements forming instrument 10 are best illustrated in FIGS. 4 and 5. A tortuous air path is formed between primary chamber 140 and resonator chamber 144 by way of a plurality of baffle walls 148. Baffle walls 148 are arranged in combination with top and bottom baffle blocks 152 and 154 to form a plurality of air conduit segments 156. The air conduit segments 156 are essentially oriented in a "folded" configuration to provide a long air resonating column in a compact instrument. Such an air resonating column may be as long as several, or even many, times as long as the instrument.

In an instrument, the length of the vibrating air column determines the base, root, or fundamental note. Additional length in an air column generally creates a lower tone. The axial spacing between baffle blocks 152 and 154 and the length and number of baffles 148 determine the length of the air column. The volume and acoustical quality of the principal root tone, and many primary overtones, are effected by the shape of the resonating chamber 144. A wide open chamber, without any end restrictions, is generally louder and more "clear" in sound. Instruments having double ended configurations tend to have a sound that may be characterized as slightly muffled in nature, although still pleasing.

Five air conduit segments 156 are illustrated in embodiment of FIG. 5, although as few as three may be present in a typical instrument. The maximum number of conduit segments 156 is determined, in part, by the width of body 104. Sound quality is observed to diminish with excessive narrowing or compacting of the air conduits 156. The minimum size conduit may be determined by personal preference in resulting sound output. A cross-section of a conduit 156 may vary in area along the length of a conduit 156, and between individual conduits 156. Changes in cross-section along the length of conduit segments 156 have an effect on the sound, particularly the overtones, produced from the instrument. It is currently preferred to have the final conduit 156, which opens into resonator chamber 144, arranged to have a continual increase in cross-section along the length of that conduit segment 156 toward end 108. Such an arrangement has been determined to produce a louder, more pleasing, sound.

Free ends 160 of baffle walls 148 may have a pointed cross-section, as illustrated in FIG. 5, to promote smooth air flow. Other cross-sectional configurations are also workable for free ends 160, including without limitation: rectangular, triangular, ovoid, ogive, or other geometric shapes. Smooth air flow is not required in an instrument, as the instrument emulates Didjeridoos formed by termites and therefore having irregular bores. Fixed ends, indicated generally at 164, of baffle walls 148 are attached to baffle blocks 152 and 154. Baffle walls 148 are attached along their lengths to front and rear sheets 120 and 124 to form substantially air tight air conduits 156. When forming an instrument of materials workable using woodworking methods, elements including body 104 and baffle structure 148, 152 and 154, may be assembled using joint methodology known to woodworkers. Typical joint structure may include one or more of: butt, lap, dado, and rabbit joints.

FIGS. 6–10 illustrate a second embodiment of an instrument, indicated generally at 20. Instrument 20 contains structural elements similar to instrument 10. These elements are designated with corresponding numerals. The primary difference between instruments 10 and 20 is that instrument 20 has a tapered body 104 having a width at bottom end 108 that is greater than a width at end 112. It has been found that the tapered body provides an acoustical enhancement, projects the sound, and increases volume.

A representative instrument 20 may be constructed having a length of about 24 inches, a substantially uniform depth of about 2 inches, and a width varying linearly between about 2 to about 3 inches. Significantly different dimensions, to construct both larger and smaller instruments, may also be used. It is also within contemplation to incorporate a nonuniform taper along the length of the body 104. The substantially uniform depth of a body 104 of instrument 20 creates joints formed by right side 128, left side 132, baffle blocks 152 and 154, and baffle walls 148 with front and rear sheets 120 and 124 that are all located in parallel planes. Such construction reliably produces substantially air-tight internal air channels 156 with relatively simple manufacturing of side and internal elements.

FIGS. 11–15 illustrate a third embodiment of instrument, indicated generally at 30. Instrument 30 also contains structural elements similar to instrument 10. Again these elements are designated with corresponding numerals. The primary difference between instruments 30 and 20 is that instrument 30 has a tapered body 104 having both a width and a depth at bottom end 108 that is greater than a width and depth at end 112. The illustrated instrument 30 is representative of a true obelisk, having a four-sided tapered columnar shape. A representative instrument 30 may be constructed having a length of about 24 inches, and both width and depth varying linearly between about 2 to about 3 inches. Significantly different dimensions, to construct both larger and smaller instruments, may also be used. It is also within contemplation to incorporate an increased amount of taper, or even a nonuniform taper, along the length of the body 104.

The nonuniform depth of the body 104 of instrument 30 creates joints formed by right side 128, left side 132, baffle blocks 152 and 154, and baffle walls 148 with front and rear sheets 120 and 124 that are all located in nonparallel planes. Such construction requires a tight tolerance on depth dimensions of the internal baffle elements to ensure a proper air seal. For example, a baffle wall 148 not aligned parallel to a center axis of body 104 and having a butt joint with front and rear sheets 120 and 124, must form a seal with surfaces that tapers in two directions simultaneously. Such a seal requires a compound angle at the joint, and involves considerably more manufacturing effort. It has been determined that tapering a body in only one direction, width or depth, is sufficiently effective to produce a most desirably enhanced tone in an instrument.

Figure 11:
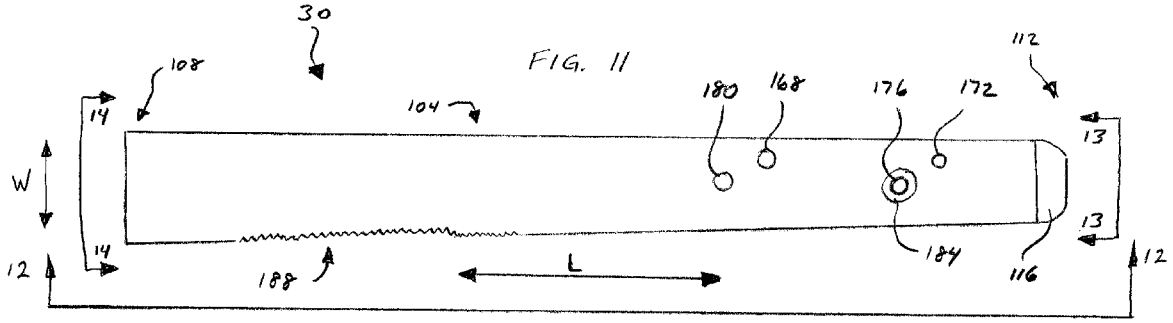
FIG. 11 illustrates a front view of a third embodiment of the invention.

Instrument 30 illustrates additional elements or features that can be incorporated in a musical instrument according to the present invention. With reference to FIG. 11, tone holes 168, 172, 176, and 180 may be positioned to correspond to notes D, E, F, and G, in the case where the instrument 30 is tuned to C Major. By covering the holes with his fingers or with plugs, and uncovering one or more while operating the instrument, the musician may create the desired fundamental note in a didjeridoo style. Of course the didjeridoo style has characteristic overtones and other distinctive sound qualities.

Alternatively, or in addition, one or more membrane element(s) 184 may be affixed to body 104 to sealingly cover one or more holes, having various shapes, through body 104. The vibrating membrane element 184 may be formed from any material capable of transverse membrane oscillation and producing a sound output. Operable materials include masking tape, cellophane, foils, waxed paper and the like. In operation, the musician may place his fingers on the membrane(s) until such time as an additional sound effect is desired while operating the instrument. Following removal of a finger, the membrane can freely oscillate, and add its sound to the instrument 30's base sound scheme. The resulting sound effect has been compared to a children's toy instrument commonly called a Kazoo.

Figure 12:
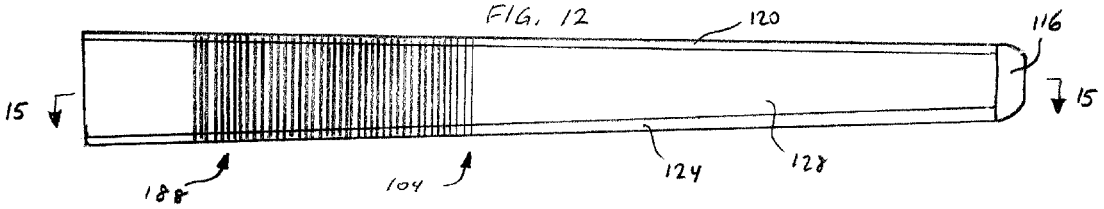
FIG. 12 illustrates a side view, looking in the direction of the arrows 12—12, of the embodiment of FIG. 11.
Figure 13:
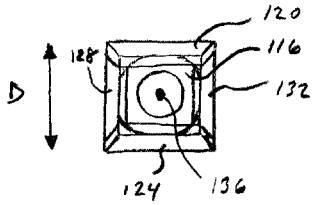
FIG. 13 illustrates an end view, looking in the direction of the arrows 13—13, of the embodiment of FIG. 11.
Figure 14:
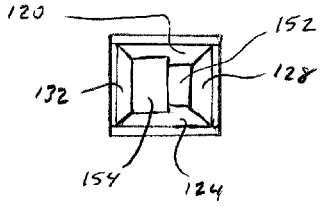
FIG. 14 illustrates an end view, looking in the direction of the arrows 14—14, of the embodiment of FIG. 11.
Figure 15:
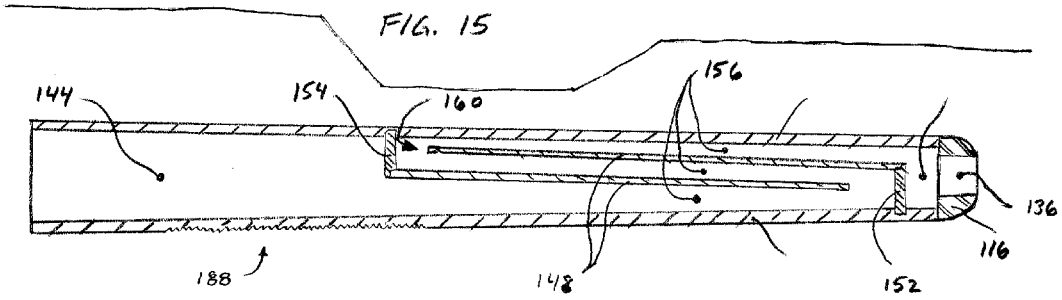
FIG. 15 illustrates a section view of the embodiment of FIG. 12, taken along section 15—15 and looking in the direction of the arrows.
Figure 16:
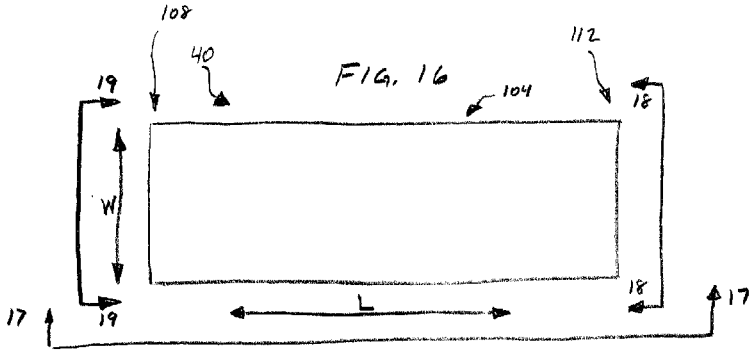
FIG. 16 illustrates a front view of a fourth embodiment of the invention.
Figure 18:
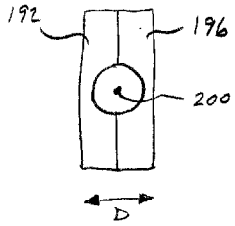
FIG. 18 illustrates an end view, looking in the direction of the arrows 18—18, of the embodiment of FIG. 16.
Figure 17:
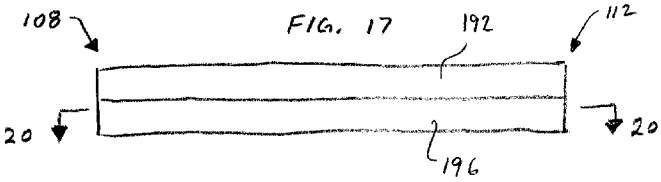
FIG. 17 illustrates a side view, looking in the direction of the arrows 17—17 of the embodiment of FIG. 16.
Figure 19:
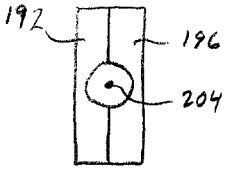
FIG. 19 illustrates an end view, looking in the direction of the arrows 19—19, of the embodiment of FIG. 16.

FIGS. 11, 12, and 15 illustrate optional friction element 188 incorporated into a side of body 104 of instrument 30.

Friction element 188 may be stroked with a stylus to produce a percussive sound effect. Friction elements 188 may be placed on multiple sides of a body 104, each such element 188 being constructed to produce an individual percussive sound. Exemplary friction elements 188 may be formed by a series of notches or various shaped irregularities embedded into the body 104. A musician may rotate the instrument 30 to select the desired friction element 188 in strokable orientation to his stylus of choice. The friction element 188 may be stroked to add a rhythm element to the Didjeridoo-style output of instrument 30, thereby adding to the one-man-band potential this invention offers.

FIG. 15 illustrates additional alternative construction details of an instrument. Free end 160 of baffle walls 148 are illustrated as blunt, or squared-off. Mouthpiece 116 is assembled to body 104 with a butt joint, compared to the lap joint in FIG. 5, or the plug fit illustrated in FIG. 10.

FIGS. 16–20 illustrate a fourth embodiment of instrument, indicated generally at 40. Instrument 40 also contains structural elements similar to instrument 10, but manufactured with alternative methods. These similar elements are designated with corresponding numerals. The primary difference between instruments 10 and 40 is that while instrument 10 is assembled from panel elements, instrument 40 may essentially be hollowed out from a single, solid, block. A representative instrument 40 may be constructed having a length of about 12 inches, a substantially uniform depth of about 1¾ inches, and a substantially uniform width of about 4⅛ inches. Significantly different dimensions, to construct both larger and smaller instruments, may also be used. It is also within contemplation to incorporate a taper, including a nonuniform taper, in width and/or in depth, along the length of the body 104.

Instrument 40, illustrated in FIGS. 16–20, is formed from two substantially mirror imaged left and right halves 192 and 196 respectively, glued together at the midplane of resulting body 104. Such construction reliably produces substantially air-tight internal air channels 156 with relatively simple manufacturing of side and internal elements. A body 104 may alternatively be constructed by forming air conduits 156 in one side member only, then sealing with a front sheet, similar to a front sheet 120. A body 104 may also be formed from any object which can be hollowed out to form air conduits 156 in a pattern to form a substantially sealed, tortuous path, air chamber. For instance, it is within contemplation to form an instrument 40 interior to a sculpture. The instant invention may therefore be embodied as a musically playable statue. One representative such statue may present an external form in the shape of a whale or dolphin. Such an external shape has significance in the ongoing attempt to communicate with such mammals, and in which effort traditional didjeridoos have found some application.

Figure 20:
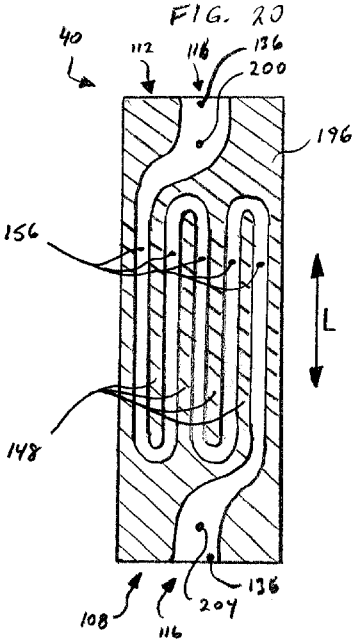
FIG. 20 illustrates a section view of the embodiment of FIG. 17, taken along section 20—20 and looking in the direction of the arrows.

Instrument 40 is an example of a two ended instrument. Instrument 40 may be played from either end 108 or 112. Illustrated top chamber 200, in FIG. 20, is a simple tubular extension of axial opening 136 in top end 112. Bottom chamber 204 has a shape similar in construction to chamber 200. A mouthpiece 116 is formed directly from each of bottom and top ends 108 and 112. Playing the instrument 40 from top end 112 may sound different than playing it from the bottom end 108. Differences in tone will depend primarily upon differences in the length, volume, and shape of chambers 200 and 204. To a lesser extent, tonal differences are effected by cross-section and length changes encountered in traversing air conduits 156 in opposite directions.

Figure 21:
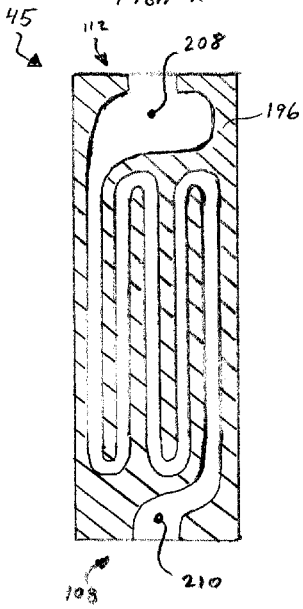
FIG. 21 illustrates a section view of a fifth embodiment of the invention, having an alternative internal construction.

With reference to FIG. 21, a fifth embodiment of an instrument 45 also is a two ended instrument, similar in construction to instrument 40. However, instrument 45 has an upper chamber 208 that is much larger than upper chamber 200. Furthermore, lower chamber 210 has a shorter length than chamber 204. Comparing the instruments 40 and 45, one would expect a lower, somewhat muffled, tone when instrument 45 is played from bottom end 108, and a higher pitch tone when played from top end 112.

Figure 22:
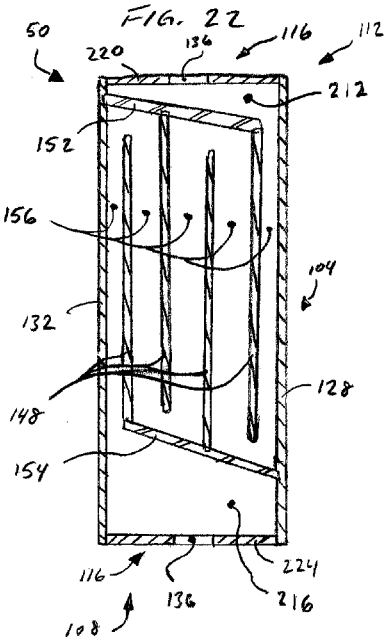
FIG. 22 illustrates a section view of a sixth embodiment of the invention, having an alternative internal construction.

A sixth, and compact, embodiment of instrument 50 is illustrated in FIG. 22. Instrument 50 is shown in cross-section, and is constructed from panel elements similar in technique to embodiments 10, 20, and 30. Top and bottom chambers 2112 and 216 may have different volumes, as illustrated, to create different pitch tones when played from opposite ends. A mouthpiece 116 is formed on top end 112 by passage 136 through top end panel 220. A second mouthpiece 116 is formed by passage 136 in bottom end 108 through bottom end panel 224. Again, the mouthpiece(s) 116 may be formed through any panel of body 104, although it is currently preferred to locate such mouthpieces at one or more of ends 108 and 112.

The illustrated embodiments may be regarded as single layer instruments. That is, conduit segments 156 are illustrated as substantially aligned in a single plane to form a layer. Individual conduit segments are "folded" within a planar slab, forming a layer. It is within contemplation to form an instrument according to the principles of this invention having two or more such layers, thereby forming an air column being wrapped, or "folded", into a 3-dimensional configuration. When constructed using a multilayer scheme, one layer merely communicates to the next layer, prior to exiting a resonant chamber 144. Furthermore, air conduits 156 need not be substantially linear segments, as illustrated. It is within contemplation to form air conduit segments 156 as arc segments, or even as a continuous spiral or other serpentine path. Such a spiral may form an instrument with a body 104 having a pancake shape. Such a pancake body 104 may be oriented perpendicular to the axis of a mouthpiece 116 or passageway 136. Alternatively, an axis through a passageway 136 may be oriented at other angles, including parallel, to a plane containing an air conduit segment 156. An instrument with spiral air conduit segments may have a body 104 conveniently fashioned as a pancake, cylinder (stacked pancakes), ball, or other ovoid shape. Either or both a mouthpiece 116 and a resonant chamber 144 may be part of such a body, or may be regarded as add-on components. Such components may have entry or exit openings located in a plane oriented independent of any axis of the instrument.

All of the embodiments illustrated and described may produce drone sounds in the approximate register and tonality of a traditional Didjeridoo. Unlike its traditional precursor, however, the invention is capable of producing scale tones, both by adjusting lip tension and by the use of tone holes. It is within contemplation to produce instruments in accordance with the invention in various sizes, shapes and pitches. Instruments may be constructed according to the present invention having cross-section shapes that are square, rectangular, oval or round, as well as other prismatic or geometric shapes. Such instruments may further be tapered in a width and/or a depth direction along the length of the instrument. In a cylindrical, round, or ovoid instrument, such taper may be characterized by a change in radius along the length of the instrument. The length of the vibrating air column productive of the fundamental pitch tone, or drone, may range from several inches to tens of feet.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A musical instrument constructed and arranged to provide a tortuous path air chamber with a first mouth piece at a first end configured to permit an instrumentalist to blow through said mouthpiece in a loose-lipped fashion, whereby to create a drone emulating a didjeridoo, wherein:

said air column is formed by a plurality of baffle walls and baffle blocks arranged to form a plurality of air column segments.

2. The instrument of claim 1, further comprising:

a body containing said tortuous path air chamber, said body having a tone hole positioned to change the fundamental note of said instrument when opened or closed.

3. The instrument of claim 1, further comprising:

a body containing said tortuous path air chamber, said body having an aperture in fluid communication with said air column and sealingly covered by a membrane, said membrane being operable to produce an audible sound during operation of said instrument.

4. The instrument of claim 1, further comprising:

a body containing said tortuous path air chamber, said body having a friction surface operable to create a percussive sound when stroked with a stylus.

5. The instrument of claim 1, further comprising:

a second mouthpiece at a second end, whereby to permit playing said instrument from either of said ends.

6. The instrument of claim 5, wherein:

said instrument is constructed and arranged such that the fundamental note has a different pitch when played from each respective said end.

7. A musical instrument constructed and arranged to provide a tortuous path air chamber with a first mouth piece at a first end configured to permit an instrumentalist to blow through said mouthpiece in a loose-lipped fashion, whereby to create a drone emulating a didjeridoo, wherein:

said air column comprises a serpentine air column segment.

8. The instrument of claim 7, further comprising:

a body containing said tortuous path air chamber, said body having a tone hole positioned to change the fundamental note of said instrument when opened or closed.

9. The instrument of claim 7, further comprising:

a body containing said tortuous path air chamber, said body having an aperture in fluid communication with said air column and sealingly covered by a membrane, said membrane being operable to produce an audible sound during operation of said instrument.

10. The instrument of claim 7, further comprising:

a body containing said tortuous path air chamber, said body having a friction surface operable to create a percussive sound when stroked with a stylus.

11. The instrument of claim 7, further comprising:

a second mouthpiece at a second end, whereby to permit playing said instrument from either of said ends.

12. The instrument of claim 11, wherein:

said instrument is constructed and arranged such that the fundamental note has a different pitch when played from each respective said end.

13. An apparatus having a body with a first length, the apparatus comprising:

a tortuous path air column having a second length, said air column having a mouthpiece at a first end and a resonating chamber at a second end; said mouthpiece comprising an interface having an orifice shaped and dimensioned to accommodate the lips of an instrumentalist such that a loose-lipped input sound may be generated; and said second length being at least one-and-one-half times as long as said first length, wherein: said air column comprises a plurality of air column segments arranged in fluid communication.

14. The apparatus of claim 13, wherein said segments are defined by a plurality of baffle walls and baffle blocks.

15. The apparatus of claim 13, wherein said segments comprise a serpentine segment.

16. The apparatus of claim 13, wherein said body comprises a tone hole operable to control the fundamental note of said instrument.

17. The apparatus of claim 13, said body comprising a through-hole in fluid communication with said air column and sealingly covered by a membrane, said membrane being operable to produce an audible sound during operation of said instrument.

18. The apparatus of claim 13, said body having a friction surface operable to create a percussive sound when stroked with a stylus.

19. A musical instrument with a body having a first length, said body being formed substantially as a hollow box, said box having an internal baffle arrangement defining an air column following a tortuous path having a second length between a mouthpiece and a sound exit port, said first and second lengths producing a compactness factor greater than about one and-one-half, and said mouthpiece providing an input orifice shaped and dimensioned to accommodate the lips of an instrumentalist such that a loose-lipped input sound may be generated.

* * * * *